US005459441A

United States Patent [19]

Weber et al.

[11] Patent Number: 5,459,441

[45] Date of Patent: Oct. 17, 1995

[54] SIGNAL PROPAGATION USING HIGH PERFORMANCE DUAL PROBE

[75] Inventors: John G. Weber, Boulder Creek; Richard C. Yu, Hayward, both of Calif.

[73] Assignee: Chaparral Communications Inc., San Jose, Calif.

[21] Appl. No.: 181,199

[22] Filed: Jan. 13, 1994

[51] Int. Cl.[6] ..... H01P 1/161; H01Q 13/00

[52] U.S. Cl. ..... 333/136; 333/137; 333/21 A; 343/786

[58] Field of Search ..... 333/125, 126, 333/135, 137, 21 A, 136; 343/756, 786

[56] References Cited

U.S. PATENT DOCUMENTS

| | | | |
|---|---|---|---|
| 4,683,440 | 7/1987 | Yoshikawa | 333/21 A X |
| 4,686,491 | 8/1987 | Howard | 333/21 A |
| 4,734,660 | 3/1988 | Lofgren | 333/21 A |
| 5,245,353 | 9/1993 | Gould | 333/21 A X |

*Primary Examiner*—Paul Gensler

*Attorney, Agent, or Firm*—William E. Pelton; Donald S. Dowden

[57] ABSTRACT

Signal propagation apparatus is formed with a waveguide cavity for propagating first and second electromagnetic signals respectively having first and second electric fields that are distinguished outside the cavity by first and second polarizations, for example orthogonal polarizations, one vertical and one horizontal. Within the cavity, the electric field lines are curved and cross one another at angles that vary as a function of location within the cavity. A pair of probes are mounted within the cavity in spaced-apart relation to each other and have orientations that differ from the orientations of the electric fields outside the cavity. In order to send or transmit signals having electric fields that are respectively vertically and horizontally polarized, for example, thereby forming an angle of 90° with respect to each other, the probes lie in planes forming a dihedral angle of about 80°. This structure maximizes probe-to-probe isolation and cross-polarization nulls between the first and second electric fields.

10 Claims, 4 Drawing Sheets

SIGNAL PROPAGATION USING HIGH PERFORMANCE DUAL PROBE

BACKGROUND OF THE INVENTION

1. Field of the Invention

This invention relates to signal propagation and, more particularly, to novel and highly effective signal propagation using a dual-probe waveguide cavity.

2. Description of the Prior Art

Because of the crowding of the electromagnetic spectrum it is the practice to use polarized signals for transmissions between, for example, satellites and ground stations. A typical case is the use of electromagnetic signals having electric fields that are linearly polarized respectively vertically and horizontally, or electric fields that are elliptically (preferably circularly) polarized respectively clockwise and counterclockwise.

Antennas are bidirectional devices. That is, they can be used for transmitting or receiving electromagnetic signals. An antenna that selectively receives signals of a given polarity can be used to selectively transmit signals of the same polarity. For the sake of concreteness, however, the following introduction is in terms of an antenna employed to receive signals.

A probe mounted in a waveguide cavity receives energy from an incoming polarized signal having an electric field in the plane of the probe and is essentially invisible to an incoming signal having an electric field normal to the plane of the probe. In order to receive signals that are linearly polarized with the electric field oriented vertically, a waveguide cavity is provided with a probe lying in a vertical plane; similarly, in order to receive signals that are linearly polarized with the electric field oriented horizontally, a waveguide cavity is provided with a probe lying in a horizontal plane. Incoming circularly and elliptically polarized signals are in effect converted within the waveguide cavity to signals that are polarized linearly. This can be done in a well known manner using a dielectric plate, for example.

Ideally, the probe is centered radially within the waveguide cavity because the electric field curves within the cavity, as explained below, and is normal to the walls defining the cavity. The best cross-polarization nulls between orthogonally polarized electric fields are obtainable at the radial center of the cavity, where the vertical and horizontal electric fields are truly orthogonal. Elsewhere, they form varying angles with each other.

To receive both signals that have linearly polarized vertical electric fields and signals that have linearly polarized horizontal electric fields, several strategies can be adopted: Obviously, separate waveguide cavities can be provided, one including a probe lying in a vertical plane and the other including a probe lying in a horizontal plane. Alternatively, a single waveguide cavity can be provided with a single centrally positioned probe and means for changing the orientation of the end of the probe nearer the open end of the cavity while maintaining the rear end of the probe fixed. The front end of the probe then can pick up either signal and reorient the electric vector to the extent necessary for reception and transmission at the rear end. Of course, only signals of one polarization can be received at any given time using this technique. A third possibility is to employ multiple fixed probes in the same cavity.

FIG. 1 is a stylized representation of vertically polarized electric field lines E within a waveguide cavity in the $TE_{11}$ transmission mode. The number of field lines E represented in FIG. 1 is of course completely arbitrary. One of these field lines, designated E1, bisects the cavity and is straight (the cavity is assumed to be cylindrical; i.e., circular in cross section). The other field lines E are curved, and each is normal to the wall of the cavity, which is electrically conductive. If FIG. 1 is rotated through 90° clockwise or counterclockwise, it represents horizontally polarized electric field lines within the waveguide.

A single conductive probe mounted in the center of the cavity can easily be made to respond to the signal by orienting it so that it lies in a plane parallel to the central electric field line El. By the same token, it can easily be made invisible to the signal by orienting it so that it lies in a plane perpendicular to the electric field line E1.

If two probes are mounted in the same cavity to receive differently polarized signals, obviously both cannot occupy the central position; they must occupy separate positions. This creates a problem of optimizing the responsiveness of each probe to polarized signals.

FIGS. 2–7 show prior attempts to address the problem. FIGS. 2 and 3 show a design that is disclosed in more detail in a patent to West U.S. Pat. No. 5,216,432. In this design, probes 10 and 12 enter the cavity 14 from the bottom 16 of the circular (actually cylindrical) waveguide 18 and have structures 20, 22 protruding from the walls of the waveguide 18 that set the impedance of the probes 10, 12 coming from the waveguide floor 16. In addition, there is an impedance-matching structure 24 in the center of the waveguide 18. The combination of these two provides adequate cross polarization and return loss from the probe to the waveguide. The additional structures 20, 22, 24 are necessary to decrease the cross talk between the two probes 10, 12 and increase the cross polarization performance by altering the field at the base of the probes 10, 12. However, these structures have the disadvantage of introducing complexity. Note also that the probes 10 and 12 lie in planes that are at 90° relative to each other, corresponding to the relative orientation of the central, bisecting electric fields within the waveguide 18.

FIGS. 4 and 5 disclose a waveguide 26 that is lengthened and has two wire probes 28, 30 that enter the waveguide 26 from the side at right angles to each other. A septum 32 divides the waveguide 26 from the standpoint of the two polarities. A disadvantage of this design is that the probes enter the printed circuit board 34 at angles of 45°, the waveguide is lengthened, and a septum is required to minimize cross talk between the probes 28, 30 and maintain high cross-polarization isolation.

FIGS. 6 and 7 disclose a waveguide 34 having a pair of probes 36, 38 that enter the waveguide from the bottom and lie in planes that form right angles with respect to each other. In this design, cross talk between the two probes and the structure of the fields in the waveguide are such that the cross-polarization isolation is reduced.

Thus in the prior art, additional structures are required in order to achieve the desired performance, or the achieved performance is less than optimum.

OBJECTS AND SUMMARY OF THE INVENTION

An object of the invention is to remedy the problems of the prior art noted above. In particular, an object of the invention is to provide signal propagation apparatus of great simplicity of construction, that nevertheless maximizes probe-to-probe isolation and cross-polarization nulls between first and second orthogonally polarized electric fields.

Another object of the invention is to provide such apparatus that is suitable for both transmission and reception and that is usable in connection with linearly and elliptically (including circularly) polarized signals.

Another object of the invention is to provide such apparatus suitable for C-band use in the frequency range of 3.7–4.2 GHz and for Ku-band apparatus in the frequency range of 11.7–12.2 GHz (U.S. standard), or Ku-band apparatus having a frequency response as low as 10.7 GHz and as high as 12.75 GHz (some foreign standards).

The foregoing and other objects are attained in accordance with the invention by the provision of signal propagation apparatus comprising: a waveguide cavity for propagating first and second electromagnetic signals respectively having first and second electric fields that are distinguished outside the cavity by first and second polarizations and within the cavity by polarizations that vary as a function of location within the cavity; and first and second probes mounted within the cavity in spaced-apart relation to each other and having orientations that differ from the orientations of the electric fields outside the cavity and maximize probe-to-probe isolation and cross-polarization nulls between the first and second electric fields.

In accordance with an independent aspect of the invention, there is provided signal propagation apparatus comprising: a cylindrical waveguide cavity for propagating first and second electromagnetic signals respectively having vertically and horizontally polarized electric fields outside the cavity and relative polarization angles that vary as a function of location within the cavity; and first and second probes mounted within the cavity in spaced-apart relation to each other and lying in respective planes that form an acute dihedral angle relative to each other, the dihedral angle being bisected by a plane inclined 45° with respect to the vertical and having a value that maximizes both probe-to-probe isolation and cross-polarization nulls between the first and second electric fields.

In accordance with another independent aspect of the invention, there is provided a method of signal propagation comprising the steps of: providing a waveguide cavity for propagating first and second electromagnetic signals respectively having first and second electric fields that are distinguished outside the cavity by first and second polarizations and within the cavity by polarizations that vary as a function of location within the cavity; mounting first and second probes within the cavity in spaced-apart relation to each other; giving the probes an orientation relative to each other that differs from the orientation of the electromagnetic fields outside the cavity; and effecting an adjustment of the orientation to maximize probe-to-probe isolation and cross-polarization nulls between the first and second electric fields.

BRIEF DESCRIPTION OF THE DRAWINGS

A better understanding of the objects, features and advantages of the invention can be gained from the following detailed description of the preferred embodiments thereof, in conjunction with the appended figures of the drawing, wherein.

DESCRIPTION OF THE PREFERRED EMBODIMENTS

In the case of two "E" field probes in a circular waveguide cavity interaction between the probes is inevitable. Since both probes cannot occupy the same physical space, they must be placed apart from each other. This creates the problem that they cannot both be in the center of the waveguide cavity. Another problem is that with small probe-to-probe separations, probe cross talk is high because of capacitive effects; the probes must be far enough apart that capacitive effects are not a problem.

Figure 8:
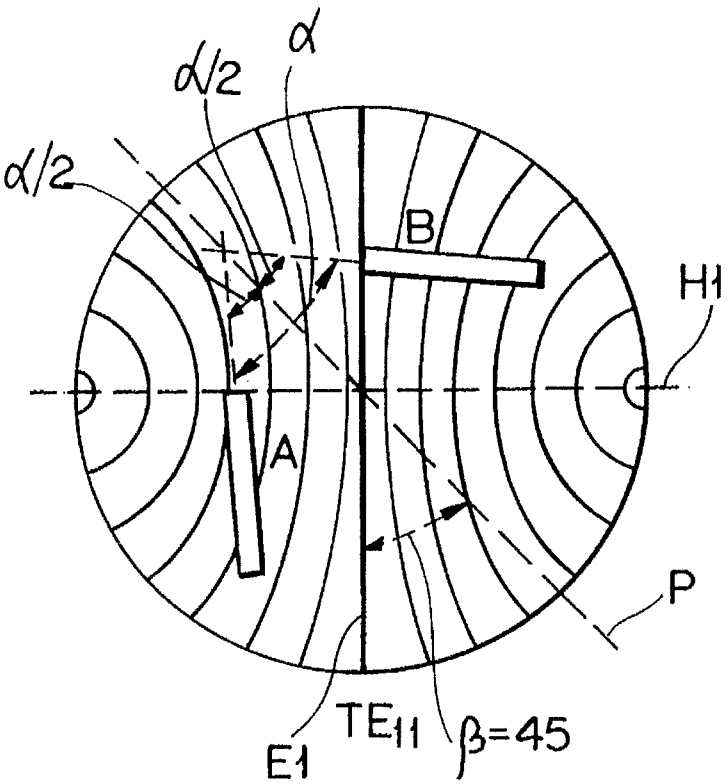
FIG. 8 is a view corresponding to FIG. 1 illustrating the principle of the present invention.
Figure 1:
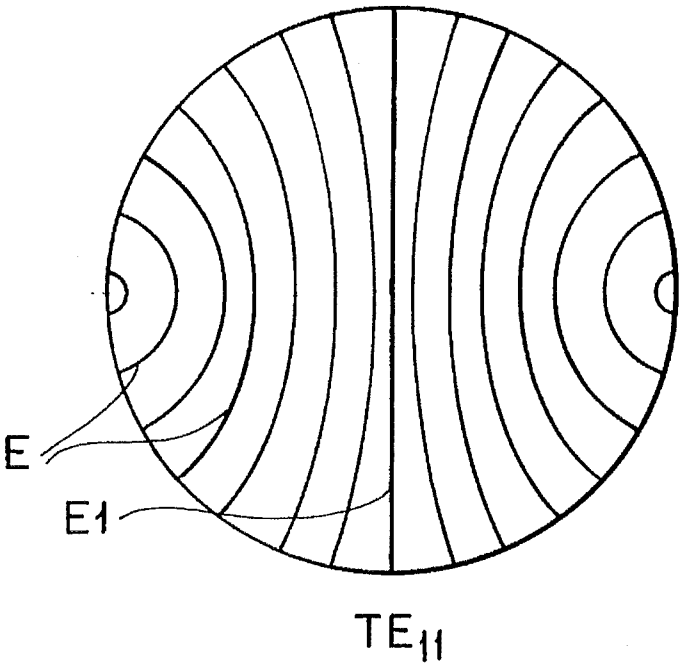
FIG. 1 is a stylized representation of vertically polarized electric field lines within a waveguide cavity in the $TE_{11}$ transmission mode, the figure when rotated through 90° clockwise or counterclockwise also representing horizontally polarized electric field lines within the waveguide cavity in the $TE_{11}$ transmission mode.
Figure 2:
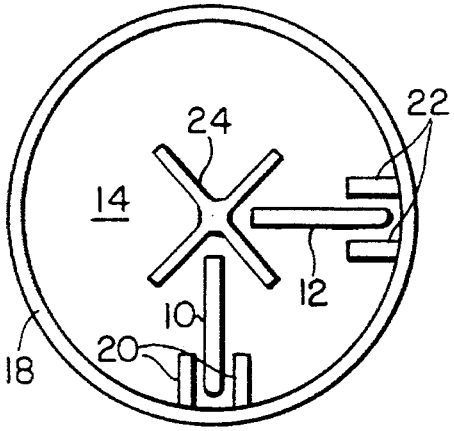
FIG. 2 PRIOR ART
FIG. 2 is an end view and FIG. 3 a side sectional view of a first structure, not in accordance with the invention, for mounting two fixed probes in a waveguide cavity in order to receive or transmit orthogonally polarized electromagnetic signals.
Figure 3:
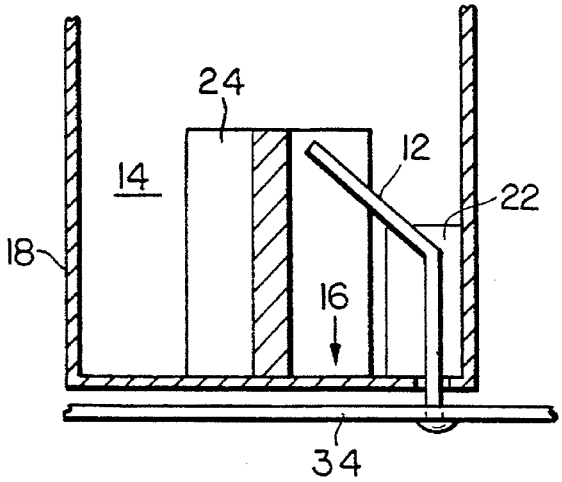
FIG. 3 PRIOR ART
Figure 4:
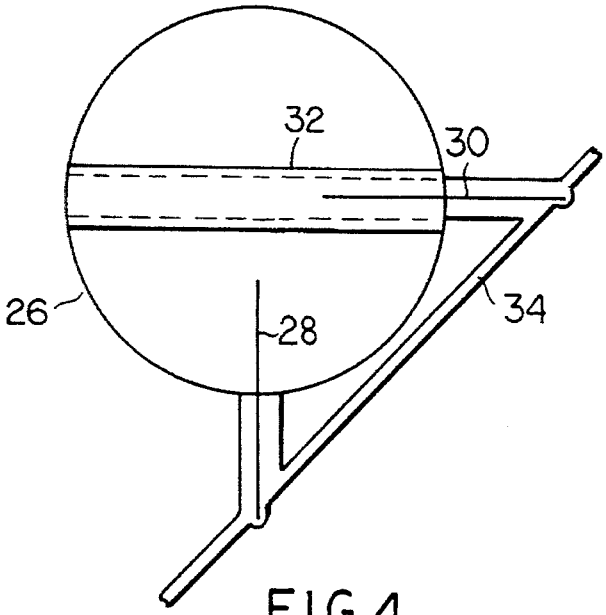
FIG. 4 PRIOR ART
FIG. 4 is an end view and FIG. 5 a side sectional view of a second structure, not in accordance with the invention, for mounting two fixed probes in a waveguide cavity in order to receive or transmit orthogonally polarized electromagnetic signals.
Figure 5:
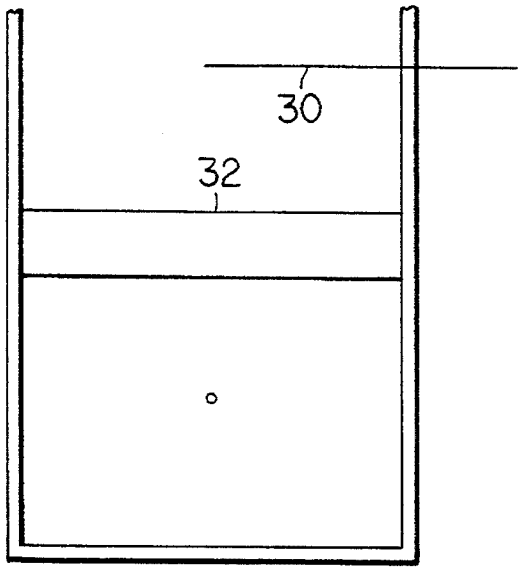
FIG. 5 PRIOR ART
Figure 7:
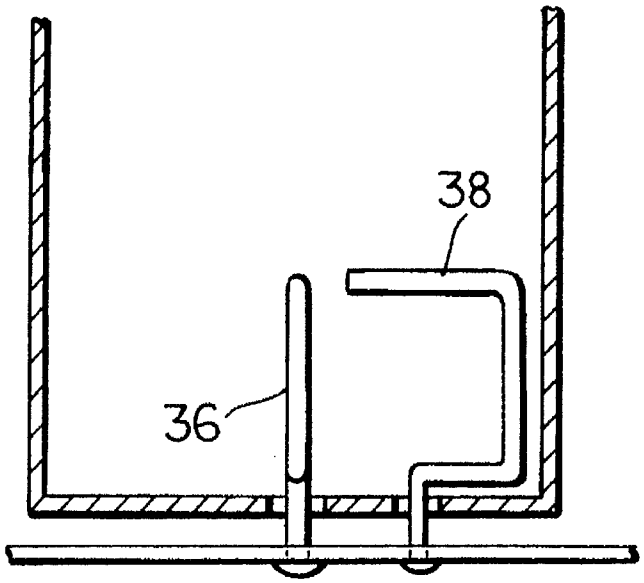
FIG. 7 PRIOR ART
Figure 6:
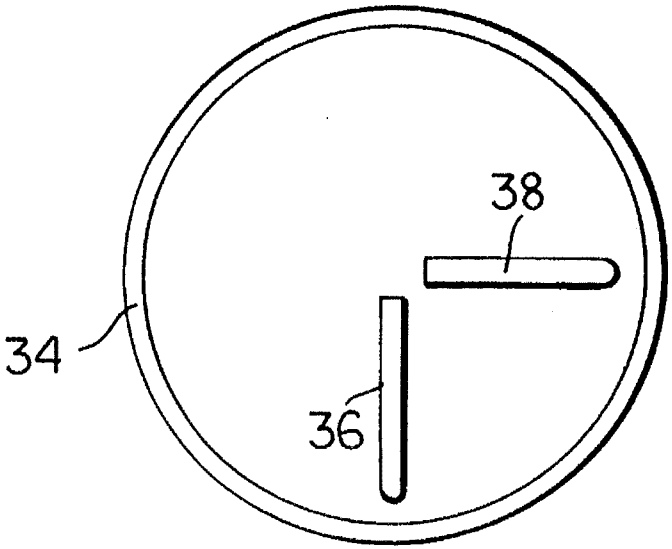
FIG. 6 PRIOR ART
FIG. 6 is an end view and FIG. 7 a side sectional view of a third structure, not in accordance with the invention, for mounting two fixed probes in a waveguide cavity in order to receive or transmit orthogonally polarized electromagnetic signals.

As indicated above, because of the nature of the electric fields in the $TE_{11}$ mode in a circular waveguide cavity, true orthogonal fields exist only in the center of the waveguide; elsewhere, the field lines are curved, as illustrated in FIGS. 1 and 8.

About the periphery of the waveguide, the electric field is perpendicular to a line tangent to the arc of the wall, and of zero value. At intermediate off-center positions, the best probe-to-probe isolation and the best cross-polarization nulls of two externally applied orthogonally polarized signals occur at something less than 90° probe separation. This is in contrast to the prior art as represented by FIGS. 2–7.

The best null or cancellation of the unwanted polarization occurs when the maximum number of field lines cross one probe at right angles. As FIG. 8 shows, a reduction of the angular separation between the probes A and B from 90° to something less will cause more of the highly curved field lines to cross the probe B more nearly perpendicular to it. The probe-to-probe linear separation and the probe-to-probe angular separation are inversely related. In the case of FIG. 8, with the probes at an angle $\alpha$ of about 80° with respect to each other maximum peak power transmission to probe A and best cross-polarization null of probe B occur simultaneously while receiving a vertically polarized signal from an outside source. If the signal from the outside source is horizontally polarized, the relationship is reversed: that is, maximum peak power transmission to probe B and best cross-polarization null of probe A occur simultaneously.

As FIG. 8 shows, the angle $\alpha$ between the planes respectively containing the probes A and B is bisected by a plane inclined 45° with respect to the vertical (or horizontal, which amounts to the same thing). The probes A and B are thus symmetrically positioned on opposite sides of a plane P that bisects the waveguide cavity and also bisects the angle $\alpha$ (dividing it into two equal angles each having a value $\alpha/2$) and the angle formed by the vertical electric field line E1 and the central electric field line H1 of an orthogonally polarized field.

Probe-to-probe isolation from 3.7 GHz to 4.2 GHz is better than 35 dB, while the cross-polarization null is better than 40 dB. Power transmission is indistinguishable when compared to a similar waveguide cavity with a single probe centrally located. Although as FIG. 8 shows the preferred reception mode is of linearly polarized signals, right and left hand circularly polarized signals (or elliptically polarized signals in the more general case) may be received with the addition of a suitable dielectric plate or similar structure.

Figure 9:
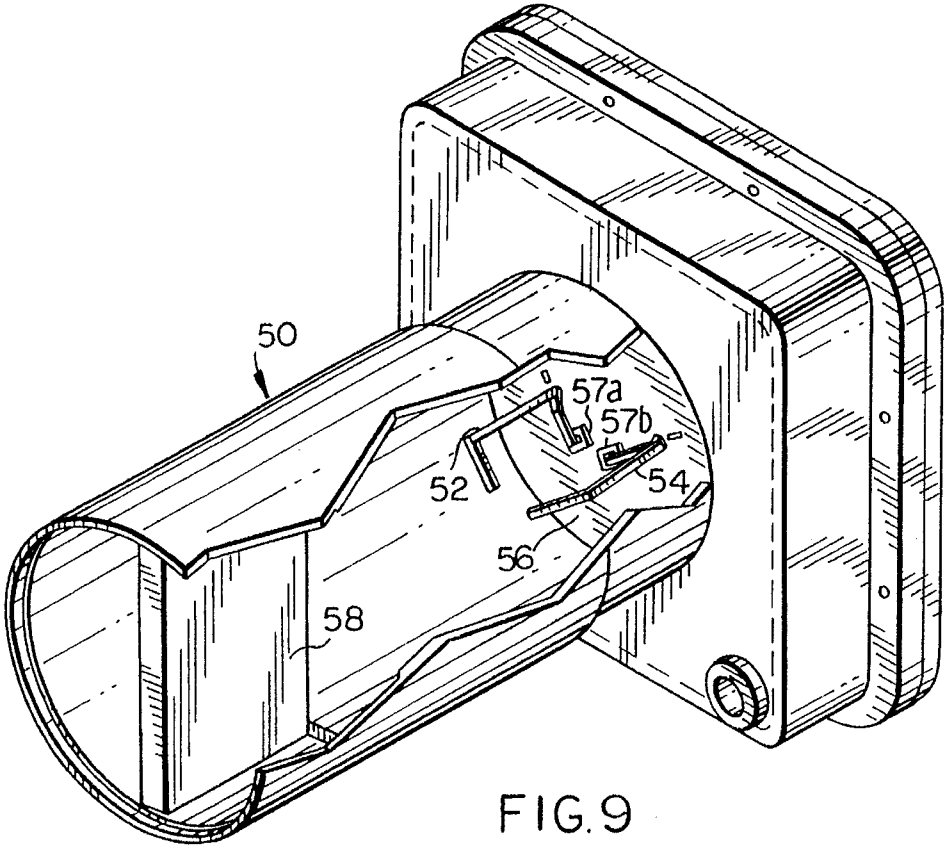
FIGS. 9–11 are, respectively, a perspective view, and end view, and a fragmentary side sectional view of apparatus constructed in accordance with the invention.
Figure 10:
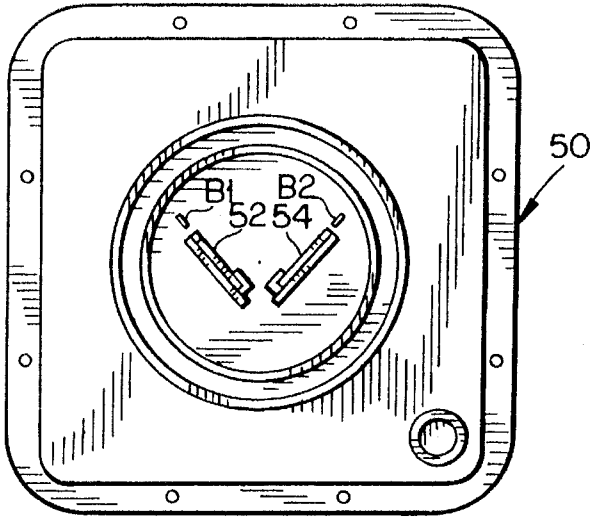
Figure 11:
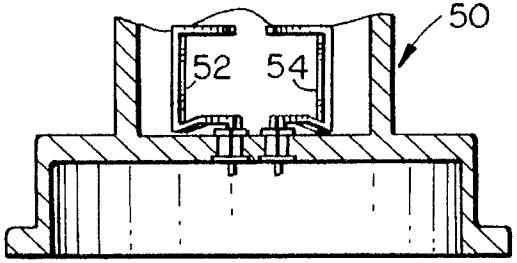

FIGS. 9–11 show one practical embodiment of a high-performance dual probe constructed in accordance with the invention. These figures disclose a waveguide 50 having a pair of probes 52, 54 that enter the waveguide from the bottom 56 through insulators 57*a* and 57*b*, respectively, and lie in planes that form an acute dihedral angle of about 80° with respect to each other. The probes are aligned with benchmarks B1, B2. A dielectric plate 58 adapts the apparatus to transmit and receive circularly (or, more generally, elliptically) polarized signals.

The probes 52 and 54 are preferably tuned (i.e., angular positioned) and fixed in position at the factory; it is also within the scope of the invention, however, to mount the probes so that they are adjustable in the field. The precise angle required to maximize probe-to-probe isolation and cross-polarization nulls between two electric fields is easily found by measurement. It is counterintuitive to orient the probes differently from the orientations of the electric fields outside the cavity; nevertheless, this change in orientation is necessary for optimum performance of a dual-probe system, particularly one that does not include any auxiliary structures such as those shown in FIGS. 2–5.

It is also preferred in accordance with the invention to incline each of the probes about 6° relative to (away from) the longitudinal axis of the waveguide 50, proceeding from the closed towards the open end of the cavity, as best indicated in the end view of FIG. 10. The impedance may be reduced by moving the probe away from the back wall 56, as those skilled in the art will readily understand.

Typical dimensions are for example a waveguide cavity having a diameter of 2.0 inches and a probe center-to-center displacement of 0.5 inches, the probes lying in planes forming a dihedral angle of about 80°.

In FIGS. 8–10, a structure for transmitting or receiving circularly polarized signals is disclosed. The same structure is adapted to transmit or receive linearly polarized signals simply by removing the dielectric plate 58. In that case, the waveguide is preferably rotated 45° from the orientation shown in FIGS. 9–11, since the linearly polarized signals are normally in the vertical and horizontal planes.

Thus there is provided in accordance with the invention a novel and highly effective signal propagation apparatus and method using a dual-probe waveguide cavity. The invention achieves the objects set out above, including simplicity of construction and maximization of probe-to-probe isolation and cross-polarization nulls between first and second orthogonally polarized electric fields.

Many modifications of the preferred embodiments of the invention described above will readily occur to those skilled in the art. It has already been mentioned that the dielectric plate 58 is optional, that the dimensions of the waveguide can vary from those typical of C-band cavities to those typical of Ku-band cavities, and that the preferred angular adjustment of the probes is related to their separation. It is also clear that the length of the cavity, the axial position of the probes within the cavity and the frequency of the propagated signals can all be varied in a manner well known to those skilled in the art without departing from the spirit and scope of the invention. The invention is to be construed therefore as including all embodiments thereof that fall within the scope of the appended claims, as well as their equivalents.

We claim:

1. Signal propagation apparatus comprising:

a cylindrical structure having an open end and a rear wall opposite said open end, said structure defining a waveguide cavity for propagating first and second electromagnetic signals respectively having first and second electric fields that are distinguished outside said cavity by first and second polarizations and within said cavity by polarizations that vary as a function of location within said cavity; and first and second probes mounted within said cavity on said rear wall in spaced-apart, nonorthogonal relation to each other and having orientations that differ angularly from the orientations of said electric fields outside said cavity and, within said cavity, maximize probe-to-probe isolation and cross-polarization nulls between the first and second electric fields.

2. Signal propagation apparatus according to claim 1 wherein the first and second electric fields are linearly polarized at 90° relative to each other outside said cavity and the first and second probes lie respectively in planes that form an acute dihedral angle relative to each other.

3. Signal propagation apparatus according to claim 2 wherein said dihedral angle is substantially 80°.

4. Signal propagation apparatus according to claim 1 wherein said electric fields are elliptically polarized respectively clockwise and counterclockwise outside said cavity and further comprising means mounted within said cavity for producing electric fields that are linearly polarized within said cavity.

5. Signal propagation apparatus according to claim 4 wherein said electric fields are circularly polarized outside said cavity.

6. Signal propagation apparatus according to claim 1 wherein said cavity is circular in cross section and, when said electric field is substantially perpendicular to one of said probes, it is substantially parallel to the other of said probes.

7. Signal propagation apparatus according to claim 1 wherein said waveguide cavity has a longitudinal axis and each of said probes is inclined about 6° relative to said longitudinal axis.

8. Signal propagation apparatus comprising: a cylindrical structure having an open end and a rear wall opposite said open end, said structure defining a cylindrical waveguide cavity for propagating first and second electromagnetic signals respectively having first and second electric fields that are vertically and horizontally polarized outside said cavity and have relative polarization angles that vary as a function of location within said cavity; and first and second probes mounted within said cavity on said rear wall in spaced-apart, nonorthogonal relation to each other and lying in respective planes that form an acute dihedral angle relative to each other, said dihedral angle being bisected by a plane inclined 45° with respect to the vertical and having a value less than 90° that, within said cavity, maximizes both probe-to-probe isolation and cross-polarization nulls between the first and second electric fields.

9. A method of signal propagation comprising the steps of:

providing a cylindrical structure having an open end and a rear wall opposite said open end, said structure defining a waveguide cavity for propagating first and second electromagnetic signals respectively having first and second electric fields that are distinguished outside said cavity by first and second polarizations and within said cavity by polarizations that vary as a function of location within said cavity;

mounting first and second probes within said cavity on said rear wall in spaced-apart, nonorthogonal relation to each other;

giving the probes an orientation relative to each other that differs from the orientation of said electromagnetic fields outside said cavity; and effecting an angular adjustment of said orientation to maximize, within said cavity, probe-to-probe isolation and cross-polarization nulls between the first and second electric fields.

10. A method according to claim 9 wherein, after said adjustment, said probes are symmetrically positioned on opposite sides of a plane that bisects said cavity and bisects an angle formed by said first and second electric fields at the center of said cavity.

* * * * *